US010178481B2

(12) United States Patent
Shao et al.

(10) Patent No.: US 10,178,481 B2
(45) Date of Patent: Jan. 8, 2019

(54) SOUND PRODUCING DEVICE

(71) Applicant: GOERTEK INC., WeiFang (CN)

(72) Inventors: Minghui Shao, Weifang (CN); Jianbin Yang, Weifang (CN)

(73) Assignee: GOERTEK INC., Weifang (CN)

( * ) Notice: Subject to any disclaimer, the term of this patent is extended or adjusted under 35 U.S.C. 154(b) by 80 days.

(21) Appl. No.: 15/323,024

(22) PCT Filed: Nov. 5, 2014

(86) PCT No.: PCT/CN2014/090339
§ 371 (c)(1),
(2) Date: Dec. 29, 2016

(87) PCT Pub. No.: WO2016/000373
PCT Pub. Date: Jan. 7, 2016

(65) Prior Publication Data

US 2017/0171664 A1 Jun. 15, 2017

(30) Foreign Application Priority Data

Jun. 30, 2014 (CN) ..... 2014 1 0307677

(51) Int. Cl.
*H04R 9/00* (2006.01)
*H04R 9/06* (2006.01)
(Continued)

(52) U.S. Cl.
CPC ..... *H04R 9/06* (2013.01); *H04R 7/127* (2013.01); *H04R 7/18* (2013.01); *H04R 9/00* (2013.01); *H04R 9/025* (2013.01)

(58) Field of Classification Search
CPC ..... H04R 9/06
(Continued)

(56) References Cited

U.S. PATENT DOCUMENTS 5,867,582 A * 2/1999 Nagayoshi ..... H04R 1/1075 381/370
6,675,931 B2 * 1/2004 Sahyoun ..... H04R 7/20 181/144
(Continued)

FOREIGN PATENT DOCUMENTS

CN 202050538 U 11/2011
CN 202077176 U 12/2011
(Continued)

OTHER PUBLICATIONS

International Search Report for International Patent Application No. PCT/CN2014/090339 filed Nov. 5, 2014.
(Continued)

*Primary Examiner* — Yosef K Laekemariam

(57) ABSTRACT

A sound producing device comprising: a speaker unit and a housing, wherein the speaker unit comprises a vibration system which comprises a vibrating diaphragm and a voice coil; a front and rear acoustic cavities are formed between the vibrating diaphragm and the housing, respectively; the side surface of the housing is provided with a sound hole communicating with the front acoustic cavity; the vibrating diaphragm comprises a dome portion and a suspension ring portion; the side of the suspension ring portion connected to the dome portion is provided with a dome connecting portion, and the side of the suspension ring portion combined with the housing is provided with a housing bonding portion; and a height difference exists between the housing bonding portion and the dome connecting portion. The present invention increases the size of the sound hole and the speaker unit, thus improving the acoustic performance of a product.

8 Claims, 2 Drawing Sheets

(51) Int. Cl.
*H04R 7/12* (2006.01)
*H04R 7/18* (2006.01)
*H04R 9/02* (2006.01)

(58) Field of Classification Search
USPC ..... 381/398, 345, 400, 386, 387
See application file for complete search history.

(56) References Cited

U.S. PATENT DOCUMENTS

| | | | | |
|---|---|---|---|---|
| 2002/0148678 | A1* | 10/2002 | Sahyoun | H04R 7/20 181/172 |
| 2004/0252859 | A1* | 12/2004 | Saiki | H04R 1/2819 381/386 |
| 2008/0205682 | A1* | 8/2008 | Jenkins | H04R 1/2826 381/349 |
| 2010/0111343 | A1* | 5/2010 | Hsu | H04R 1/2834 381/335 |
| 2010/0189284 | A1 | 7/2010 | Kuze et al. | |
| 2010/0289968 | A1* | 11/2010 | Koike | H04N 5/642 348/738 |
| 2014/0355806 | A1* | 12/2014 | Graff | H04R 1/025 381/334 |
| 2015/0358705 | A1* | 12/2015 | Chen | H04R 1/2842 381/386 |

FOREIGN PATENT DOCUMENTS

| | | | |
|---|---|---|---|
| CN | 202374440 | U | 8/2012 |
| CN | 103118320 | A | 5/2013 |
| CN | 203086730 | U | 7/2013 |
| CN | 103297904 | A | 9/2013 |
| CN | 203301728 | U | 11/2013 |
| CN | 204014043 | U | 12/2014 |
| WO | WO 2013/097330 | A1 | 7/2013 |

OTHER PUBLICATIONS

Office Action from Chinese Patent Office for Application No. 201410307677.X, dated Feb. 3, 2017.

Office Action from Korean Patent Office for Korean Application No. 10-2016-7029111, dated May 22, 2017.

Office Action from Chinese Patent Office for Chinese Application No. 201410307677.X, dated Sep. 26, 2017.

Office Action from Chinese Patent Office for Application No. 201410307677.X, dated Dec. 25, 2017.

* cited by examiner

SOUND PRODUCING DEVICE

CROSS-REFERENCE TO RELATED APPLICATIONS

The present specification is a U.S. National Stage of International Patent Application No. PCT/CN2014/090339, filed Nov. 5, 2014, which claims priority to and benefit of Chinese Patent Application No. 201410307677. X filed Jun. 30, 2014, the entire contents of which are incorporated herein by reference.

TECHNICAL FIELD

The present invention relates to the technical field of electroacoustic conversion, and more particularly, to a sound producing device capable of enlarging sound radiation area.

BACKGROUND ART

With the social progress and technical development, the volume and thickness of the terminal electronic device are reduced, and the volume of the miniature sound producing device cooperated therewith becomes smaller and smaller. However, the requirement on the performance of products is increasingly higher. As for sound producing devices with a smaller volume, it is difficult to achieve ideal acoustic effects due to the limitation on the volume.

The sound producing device usually comprises a speaker unit and a housing provided around the speaker unit. The speaker unit usually comprises a vibration system and a magnetic circuit system. The vibration system comprises a vibrating diaphragm and a voice coil. The magnetic circuit system forms a magnetic gap for accommodating the voice coil. The vibrating diaphragm vibrates under the driving of the voice coil, so as to produce sound which is radiated to outside to be heard. Typically, a sound hole is provided at the housing of the sound producing device, and enables the sound produced in the speaker unit to be radiated to outside. However, due to the limitation on the size of the sound producing device, the sound hole is usually small, it is difficult to effectively radiate acoustic waves produced by the speaker unit. If the sound hole is enlarged, the volume of the speaker unit will be decreased, and meanwhile, the acoustic performance of the sound producing device is affected.

Thus, it is required to provide a sound producing device to solve the above problems.

SUMMARY

The technical problem to be solved by the present invention is to provide a sound producing device, and the sound producing device may effectively increase the size of the sound hole in the case of a certain size of the sound producing device, thereby improving the radiant efficiency of the sound hole, increasing the size of the speaker unit concurrently, and improving acoustic performance.

In order to solve the above technical problem, the present invention provides a sound producing device, comprising a speaker unit and a housing for accommodating and fixing the speaker unit; the speaker unit comprises a vibration system and a magnetic circuit system, the vibration system comprises a vibrating diaphragm and a voice coil bonded to a side of the vibrating diaphragm, and the magnetic circuit system is formed with a magnetic gap for accommodating the voice coil; a front acoustic cavity is formed between a front side of the vibrating diaphragm and the housing, and a rear acoustic cavity is formed between a rear side of the vibrating diaphragm and the housing, wherein a sound hole is provided at a lateral side of the housing, and the sound hole is in communication with the front acoustic cavity; the vibrating diaphragm comprises a dome portion located at a central position thereof and a suspension ring portion located at an edge position thereof, an edge of the suspension ring portion is fixedly bonded to the housing, a dome connecting portion is provided at a side of the suspension ring portion connected to the dome portion, and a housing bonding portion is provided at a side of the suspension ring portion bonded to the housing; and a portion of the housing bonding portion is located at a port of the sound hole, and a height difference exists between the housing bonding portion and the dome connecting portion.

In addition, it is preferred that, the housing comprises an upper housing and a middle housing, and the sound hole is formed between the upper housing and the middle housing; the suspension ring portion of the vibrating diaphragm is bonded to the middle housing, the housing bonding portion is formed at a position where the suspension ring portion is bonded to the middle housing, and the position of the housing bonding portion is lower than that of the dome connecting portion.

In addition, it is preferred that, the suspension ring portion of the vibrating diaphragm has a concave structure which is bent towards a side closer to the magnetic circuit system.

In addition, it is preferred that, a metal sheet is injection-molded at a portion of the upper housing facing the vibrating diaphragm.

In addition, it is preferred that, the height difference between the dome connecting portion and the housing bonding portion is in a range of 0.2 mm to 0.6 mm.

In addition, it is preferred that, a height of the dome portion of the vibrating diaphragm is the same as that of the dome connecting portion.

In addition, it is preferred that, a passive sound source is further provided in the rear acoustic cavity, and the passive sound source comprises two passive radiators opposite to each other.

In addition, it is preferred that, the middle housing is provided with a reinforcing rib.

By adopting the above technical solution, compared with conventional structures, in the sound producing device provided by the present invention, there is a height difference between two ends of the suspension ring portion of the vibrating diaphragm, which may not only increase the size of the sound hole, but also increase the size of the speaker unit, thereby improving the acoustic performance of the product.

BRIEF DESCRIPTION OF THE DRAWINGS

By referring to the descriptions in connection with the accompanying drawings and the contents of the claims, and with a full understanding of the present invention, other purposes and results of the present invention will be more clearly and easily understand. In the drawings:

DETAILED DESCRIPTION OF EMBODIMENTS

Hereinafter, the particular embodiments of the present invention will be described in connection with the accompanying drawings.

Figure 1:
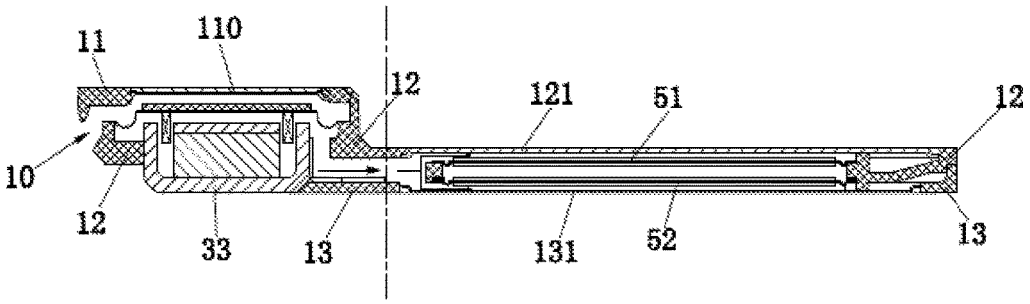
FIG. 1 is a sectional structure diagram of the sound producing device according to the present invention.
Figure 2:
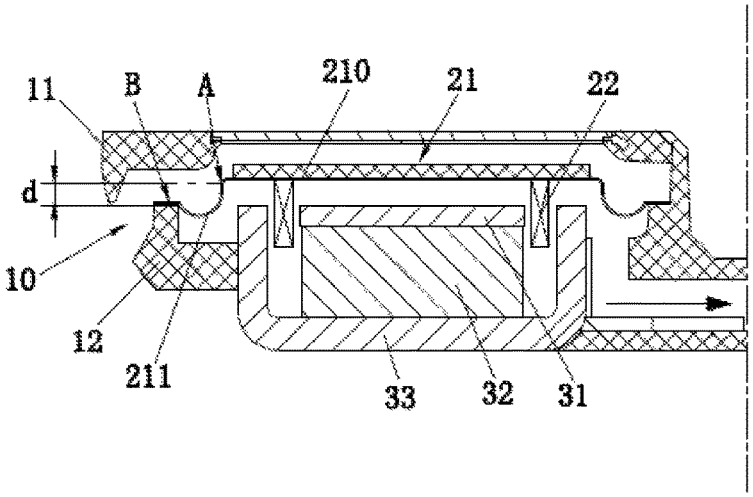
FIG. 2 is a sectional structure diagram of the speaker unit part shown in FIG. 1 according to the present invention.

Combined with FIG. 1 and FIG. 2, the sound producing device of the present invention comprises a vibration system, a magnetic circuit system and a housing for accommodating and fixing the vibration system and the magnetic circuit system, wherein the housing comprises an upper housing 11, a middle housing 12 and a lower housing 13. The vibration system comprises a vibrating diaphragm 21 and a voice coil 22 bonded to the lower side of the vibrating diaphragm 21; the magnetic circuit system comprises a pole plate 31, a magnet 32 and a yoke 33 that are sequentially bonded together. In the magnetic circuit system, there is a gap between the outer lateral surfaces of the pole plate 31 as well as the magnet 32 and the lateral wall of the yoke 33, the gap is the magnetic gap in which the voice coil 22 is accommodated, and the magnetic lines formed by the magnetic circuit system pass through the voice coil 22. Wherein, the voice coil 22 is typically formed by winding conductive metal wires, for example, copper-clad aluminum wires. The voice coil 22 is subjected to Ampere force and moves in the magnetic field formed by the magnetic circuit system when an electric signal is applied to the voice coil 22. The signal applied to the voice coil 22 is an alternating signal, and the magnitude and direction of the Ampere force are changed in accord with the signal. Thus, the voice coil 22 vibrates in the magnetic gap up and down due to the effect of the Ampere force. As the voice coil 22 and the vibrating diaphragm 21 are fixedly and integrally bonded, the vibrating diaphragm 21 will vibrate with the voice coil 22, thereby producing sound.

The vibrating diaphragm 21 comprises a tabulate dome portion 210 located at the central position thereof, and a suspension ring portion 211 located at the edge of the dome portion, as shown in FIG. 2. A rigid composite layer (not labeled) is typically bonded to the dome portion 210, and has good rigidity and lighter weight. The addition of composite layer may be beneficial to improvement of the high frequency properties of the vibrating diaphragm 21, and prevention of the vibrating diaphragm 21 from split vibration in high frequency band. The suspension ring portion 211 is connected to the dome portion 210 and has an arcuate and flexible structure which enables the vibrating diaphragm 21 to vibrate up and down but not drag the vibrating diaphragm 21 excessively. The suspension ring portion 211 in the present embodiment has a concave structure, that is, a structure bending towards a side closer to the magnetic circuit system. The concave structure of the suspension ring portion 211 is specifically provided in accord with the specific structure of the loudspeaker module to avoid collision to the upper housing 11, so as to fully use the inner space of the module, thereby facilitating reducing the thickness of the sound producing device, and increasing the overall size of the speaker unit.

Figure 3:
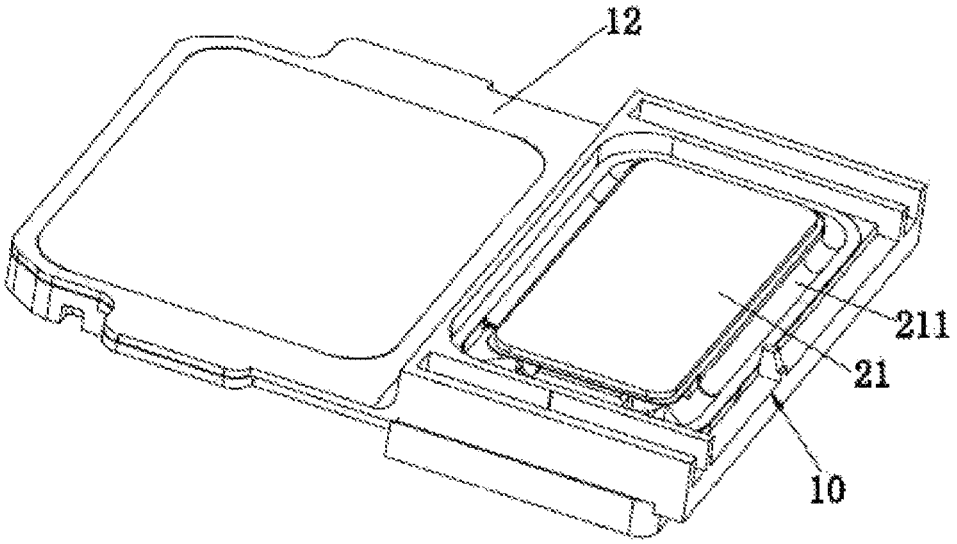
FIG. 3 is a three-dimensional structure diagram showing the sound producing device with the upper housing removed according to the present invention.

The sound producing device has a structure emitting sound at the lateral side and comprises an upper housing 11 and a lower housing 12, and a sound hole 10 of the speaker unit is formed between the upper housing 11 and the middle housing 12. As shown in FIG. 1 and FIG. 2, the sound hole 10 is located at the lateral side of the sound producing device. After the assembly of the sound producing device and the terminal electronic device, the sound hole 10 is located at the lateral side as well, which avoids blocking the sound hole 10 when the electronic device lies flat. Wherein the vibrating diaphragm 21 is bonded to the middle housing 12, more specifically, the edge of the suspension ring portion 211 is bonded to the middle housing 12, as shown in FIG. 1 to FIG. 3. Wherein a portion of the structure where the suspension ring portion 122 is bonded to the middle housing 12 is located on the port of the sound hole 10. In the case of the certain size of the sound producing device, there is height difference between two ends of the suspension ring portion 211 provided by the present invention, in order to enlarge the size of the sound hole 10 and radiate the sound produced by the vibrating diaphragm 21 to outside more smoothly. The suspension ring portion 211 comprises a dome connecting portion A connected to the dome portion 210, and a housing bonding portion B located at the other side of the suspension ring portion 211 and fixedly bonded to the middle housing 12, wherein there is height difference d between the dome connecting portion A and the housing bonding portion B, as shown in FIG. 2. The bonded suspension ring portion 211 has a concave structure, and the position of the housing bonding portion B is lower than that of the dome connecting portion A, that is, the distance between the housing bonding portion B and the bottom wall of the yoke 33 is less than the distance between the dome connecting portion A and the bottom wall of the yoke 33, as jointly shown in FIG. 2 and FIG. 3.

Preferably, the height difference d between the dome connecting portion A and the housing bonding portion B is in a range of 0.2 mm to 0.6 mm. When the height difference d is within the range above, the acoustic performance of the vibrating diaphragm can be ensured.

Preferably, the height of the dome portion 210 of the vibrating diaphragm 21 is the same as that of the dome connecting portion A. But it is not limited to this structure.

The upper side of the sound hole 10 provided by the present invention is an end surface of the upper housing 11, and the lower side of the sound hole 10 is an end surface of the middle housing 12. As the upper housing 11 is required to have a certain thickness to ensure the strength of the housing, it is only possible to maximize the sound hole 10 by lowering the height of the middle housing 12. Accordingly, the position of the suspension ring portion 211 bonded to the middle housing 12 should be lowered. In order to not affect the size of the speaker unit, two ends of the suspension ring portion 211 are provided as the above structure with the height difference. The structure with the height difference between two ends of the suspension ring portion 211 may enlarge the size of the sound hole, and facilitate the increase in size of the speaker unit concurrently, thereby effectively improving the acoustic performance of the sound producing device.

The upper housing 11 of the protective frame is positioned at the upper side of the vibrating diaphragm 21, and the upper housing 11 comprises a plastic body, and may have a metal sheet 110 provided in the central position of the upper housing 11 by injection molding. Compared with plastic material, metallic material may have the required strength in thinner thickness. Thus, the structure with a metal sheet 110 injection-molded in the upper housing 11 may decrease the thickness of the sound producing device, or may increase the inner space of the sound producing device in the case of that the thickness of the sound producing device is defined, thereby increasing the size of the speaker unit and improving the acoustic performance of the product. The middle housing 12 fixes the magnetic circuit system, the upper housing 11 and the middle housing 12 are fixedly bonded by adhering or ultrasonic welding, and the upper housing 11 and the middle housing 12 accommodate and fix the speaker unit.

The inner space of the sound producing device is divided into a front acoustic cavity and a rear acoustic cavity through the vibrating diaphragm 21. The front acoustic cavity is a space formed by the upper side of the vibrating diaphragm 21 (a side away from the voice coil 22), the upper housing 11 and the middle housing 12. The front acoustic cavity is in communication with the sound hole 10 to radiate sound to outside. However, the present invention is not limited to this structure, and alternatively, the rear acoustic cavity may be in communication with the sound hole 10. The rear acoustic cavity is an acoustic cavity formed at a side of the vibrating diaphragm 21 closer to the magnetic circuit system. While conventional rear acoustic cavity is a closed structure, a passive sound source is provided in the rear acoustic cavity provided by the present invention.

As shown in FIG. 1, two passive radiators may be provided in the rear acoustic cavity of the sound producing device provided by the present invention, i.e., a passive radiator 51 and a passive radiator 52. The passive radiator 51 and the passive radiator 52 are arranged in parallel and opposite to each other, and a cavity is formed between the passive radiator 51 and the passive radiator 52. In the present embodiment, the passive radiator 51 and the passive radiator 52 have a same structure, but are not limited thereto. When acoustic waves produced at the rear side of the vibrating diaphragm 21 in the speaker unit spread to the passive sound source, the acoustic waves spread to the sides of the passive radiator 51 and the passive radiator 52 away from each other respectively, i.e., the air flow is divided into two parts, which flow to the upper side of the passive radiator 51 and the lower side of the passive radiator 52 respectively, which enables the air in the cavity between the two passive radiators to be pressed to pass through the sound hole for the passive sound source to outside. The structure with a passive radiator provided in the rear acoustic cavity may fully use the space in the rear acoustic cavity, vibrate the passive radiators by using the acoustic waves in the rear acoustic cavity, so as to produce sound, i.e., produce bass sound, therefore, the bass effect of the whole sound producing device is improved.

As shown in FIG. 1, the rear acoustic cavity of the sound producing device is mainly formed by the middle housing 12 and the lower housing 13. Likewise, in order to fully use the space in the sound producing device, a metal sheet 121 may be injection-molded at the position on the middle housing 12 facing the passive radiator 51, and similarly, a metal sheet 131 may be injection-molded at the position on the lower housing 13 facing the passive radiator 52. With the structure of injection-molding sheet metals at the positions where the vibration amplitudes of the passive radiators 51 and 52 are relatively larger, the height (space) at said positions may be increased, so as to provide sufficient space for the two passive radiators to vibrate, thereby ensuring the acoustic performance of the sound producing device.

In addition, a reinforcing rib 12 may be provided at the position on the middle housing 12 corresponding to the sound hole 10, the reinforcing rib 12 may reinforce the structural strength at the sound hole 10, thereby avoiding collapse in the upper housing 11 and/or middle housing 12.

As described above, the sound producing device provided by the present invention is described by way of example with reference to the accompanying drawings. However, it should be understood by those skilled in the art that various improvements can be made to the above sound producing device provided by the present invention without depart from the contents of the present invention. Accordingly, the scope of protection of the present invention is determined by the contents of the appended claims.

The invention claimed is:

1. A sound producing device, comprising: a speaker unit and a housing for accommodating and fixing the speaker unit, wherein the speaker unit comprises a vibration system and a magnetic circuit system, the vibration system comprises a vibrating diaphragm and a voice coil bonded to a side of the vibrating diaphragm, and the magnetic circuit system is formed with a magnetic gap for accommodating the voice coil; and a front acoustic cavity is formed between a front side of the vibrating diaphragm and the housing, and a rear acoustic cavity is formed between a rear side of the vibrating diaphragm and the housing, wherein a sound hole is provided at a lateral side of the housing, and the sound hole is in communication with the front acoustic cavity;

the vibrating diaphragm comprises a dome portion located at a central position thereof and a suspension ring portion located at an edge position thereof, an edge of the suspension ring portion is fixedly bonded to the housing, a dome connecting portion is provided at a side of the suspension ring portion connected to the dome portion, and a housing bonding portion is provided at a side of the suspension ring portion bonded to the housing; and a portion of the housing bonding portion is located at a port of the sound hole, and a height difference exists between the housing bonding portion and the dome connecting portion, wherein the position of the housing bonding portion is lower than that of the dome connecting portion, the suspension ring portion of the vibrating diaphragm has a concave structure which is concave downward and bent towards a side closer to the magnetic circuit system wherein a position of the housing bonding portion at which the suspension ring portion of the vibrating diaphragm is bonded to the housing is lower than that of the dome connecting portion, and the suspension ring portion of the vibrating diaphragm has a concave structure which is bent towards a side closer to the magnetic circuit system.

2. The sound producing device according to claim 1, wherein the housing comprises an upper housing and a middle housing, and the sound hole is formed between the upper housing and the middle housing the suspension ring portion of the vibrating diaphragm is bonded to the middle housing, the housing bonding portion is formed at a position where the suspension ring portion is bonded to the middle housing.

3. The sound producing device according to claim 2, wherein a metal sheet is injection-molded at a portion of the upper housing facing the vibrating diaphragm.

4. The sound producing device according to claim 1, wherein the height difference between the dome connecting portion and the housing bonding portion is in a range of 0.2 mm to 0.6 mm.

5. The sound producing device according to claim 1, wherein a height of the dome portion of the vibrating diaphragm is same as that of the dome connecting portion.

6. The sound producing device according to claim 1, wherein a passive sound source is further provided in the rear acoustic cavity, and the passive sound source comprises two passive radiators opposite to each other.

7. The sound producing device according to claim 2, wherein the middle housing is provided with a reinforcing rib.

8. The sound producing device according to claim 1, wherein the entire vibration system is disposed within the housing.

* * * * *